US005459911A

United States Patent [19]

Iwami

[11] Patent Number: 5,459,911

[45] Date of Patent: Oct. 24, 1995

[54] APPARATUS AND METHOD FOR RAISING A FLUFFY SURFACE ON CLOTH

[75] Inventor: Hideo Iwami, Kyoto, Japan

[73] Assignee: Naigai Special Dyeing Co., Ltd., Kyoto, Japan

[21] Appl. No.: 132,934

[22] Filed: Oct. 7, 1993

[30] Foreign Application Priority Data

Oct. 9, 1992 [JP] Japan ..... 4-297668

[51] Int. Cl.[6] ..... D06C 11/00

[52] U.S. Cl. ..... 26/28; 26/29 R

[58] Field of Search ..... 26/27, 28, 19, 26/29 R, 37, 18.5, 2 R, 32; 28/159, 162, 165, 167; 68/8, 31, 42, 65, 84, 86, 90

[56] References Cited

U.S. PATENT DOCUMENTS

| | | | |
|---|---|---|---|
| 15,199 | 6/1856 | Stewart | 68/65 |
| 1,285,438 | 11/1918 | Smith | 26/37 |
| 1,344,777 | 6/1920 | Stroud | 26/28 |
| 2,035,641 | 3/1936 | Dickie et al. | 26/27 |
| 3,973,359 | 8/1976 | Spencer et al. | 26/28 |
| 4,512,065 | 4/1985 | Otto | 26/28 |
| 5,109,630 | 5/1992 | Love et al. | 26/28 |

FOREIGN PATENT DOCUMENTS

| | | | |
|---|---|---|---|
| 2825632 | 12/1979 | Germany | 26/37 |
| 636300 | 12/1978 | U.S.S.R. | 26/37 |
| 1592151 | 7/1981 | United Kingdom | 26/19 |

*Primary Examiner*—Clifford D. Crowder
*Assistant Examiner*—Amy B. Vanatta
*Attorney, Agent, or Firm*—Lowe, Price, LeBlanc & Becker

[57] ABSTRACT

A method for obtaining a fluffy surface on cloth on which short fluff is thickly and uniformly formed. In this fluff-raising process there is no deterioration of the cloth such as undue heating of cloth or the cutting off of raised fibers. The method includes the conveying of the cloth between a working rotary member formed of a cylindrical grindstone and a pressure-contact member having a cooperating circular arc-shaped concave surface portion with which a part of a peripheral surface of the working rotary member is cooperatively engaged. The pressure-contact member is disposed in such a manner that the circular arc-shaped concave surface portion thereof faces closely to the adjacent part of the peripheral surface of the working rotary member. A hydraulic pressure is applied from the circular arc-shaped concave side of the pressure-contact member to the cloth, while the cloth is conveyed by rotation of the working rotary member, so that the cloth is brought into close contact with the peripheral surface of the working rotary member.

18 Claims, 1 Drawing Sheet

APPARATUS AND METHOD FOR RAISING A FLUFFY SURFACE ON CLOTH

BACKGROUND OF THE INVENTION

1. Field of the Invention

The present invention relates to a raising method which is one of various treatments applied to cloth, and more particularly to a raising method to obtain a cloth on the surface of which short fluff is thickly formed like a leaf of lotus or a fruit of peach, and also to an apparatus for preferably carrying out such a raising method.

2. Background of the Related Art

Hitherto, various types of card clothing raising machines have been employed as raising apparatus of cloth. In these card cloth raising machines, a card cloth comprising a fabric embedded with needles bent in a certain direction is wound round a drum. When the drum is rotated, the surface of a cloth contacted thereby is scratched and fibers of yarns forming the cloth are raised to the extent of forming a flannel like fluff. Given such a raising finish, a cloth having an appearance of sufficient thickness and softness is achieved.

Recently, a cloth product of which the surface fluff is short and thickly formed like a leaf of lotus or a fruit of peach has been increasingly demanded. For the purpose of obtaining such a cloth product finished by raising, an emery raising machine is employed, and this emery raising machine comprises a drum to the cylindrical outer surface of which a layer of emery tape is adhered.

For the purpose of finishing a woolen fabric of high quality by raising, a teazel raising machine is popularly employed. In the teazel raising machine, a drum provided with a number of teazels on the cylindrical outer surface is rotated at high speed thereby performing the raising. In the raising by the teazel raising machine, a wet raising, in which raising takes place after giving a sufficient moisture to a cloth such as woollen fabric, is usually performed. In this wet raising, fibers are prevented from being cut off.

However, when using the above mentioned emery raising machine to obtain a cloth on the surface of which short fluff is thickly formed, a serious problem exists in that frictional heat is generated by contact between the drum and the cloth and fibers of the cloth are cut between the dry surface of the cloth and the teazel tape adhered to the adjacent drum rotating at high speed, eventually resulting in poorer texture and appearance of the finished cloth. Another problem in the use of the emery raising machine exists in that fluff and waste thread produced from the cloth may get caught in the teazels, thereby inhibiting provision of an even and uniform raising treatment. On the other hand, when practicing the wet raising by means of a teazel raising machine, it is certain that long fluff such as woolen fablic can be raised, but this raising method is not always suitable for cloth formed of relatively short yarn such as cotton fabric.

SUMMARY OF THE INVENTION

The present invention was made to solve the above-discussed problems and has the principal object of providing a raising method of cloth in which cloth having a thickly formed short fluff on a threaded surface is obtained, and during the raising process there is no disadvantage such as heating of cloth, cutting of fibers, or deterioration, so that a uniform raising treatment is achieved. The invention has another object of providing a raising apparatus for preferably carrying out the mentioned raising method.

To accomplish the foregoing objects, the raising method of cloth according to the invention employs either a working rotary member formed of a cylindrical grindstone or a working rotary member formed of a supporting member of which peripheral surface is coated with sand cloth, and a pressure-contact member having a circular arc-shaped concave surface portion with which a part of the peripheral surface of said working rotary member is cooperative during use engaged during use. The raising method comprises the steps of: conveying a length of cloth which to be treated through a space between a working rotary member, said rotary member being driven round an axis and comprising one of either a cylindrical grindstone of a cylindrical support member having a peripheral surface coated with sand cloth and a pressure-contact member having a circular arc-shaped concave surface with which a part of a peripheral surface of said working rotary member cooperates to engage the cloth and which is disposed in such a manner that said circular arc-shaped concave surface faces closely to said part of the peripheral surface of said working rotary member; and applying a pressure via said pressure-contact member to the cloth, while conveying the cloth by rotation of the working rotary member, so that the cloth is brought into close contact with the peripheral surface of the working rotary member.

The raising apparatus for carrying out the aforementioned raising method comprises: a working rotary member which is rotatably supported so as to rotate around an axis of rotation, said rotary member comprising one of either a cylindrical grindstone or a cylindrical supporting member having a peripheral surface coated with sand cloth; a pressure-contact member having a circular arc-shaped concave surface with which a part of the peripheral surface of said working rotary member cooperates to engage the cloth, said pressure-contact member being disposed such that said circular arc-shaped concave surface thereof faces closely to a part of the peripheral surface of said working rotary member, wherein an internal part said pressure-contact member includes a water tank part, and a water outflow opening is provided in said circular arc-shaped concave surface to communicate with said water tank part; cloth conveying means for conveying a length of the cloth to be treated by passing the cloth between said part of the peripheral surface of said working rotary member and said circular arc-shaped concave; driving means for rotating said working rotary surface of the contact member; driving means for rotating said working rotary member; and hydraulic pressure application means for supplying water to said water tank part of the pressure-contact member and causing water to flow out through said water outflow opening of the circular arc-shaped concave to apply hydraulic pressure to the cloth, thereby pressing the cloth on the peripheral surface of said working rotary member.

It is preferable to provide a recovery tank for recovering the water flowing out through the water outflow opening on the circular arc-shaped concave of said pressure-contact member so as to utilize the water in a recycling manner by said hydraulic pressure application means.

In the method of treating cloth per the above arrangement, the circular arc-shaped concave of the pressure-contact member and a part of the peripheral surface of the working rotary member are disposed to be facing close to each other to cooperate with each other, and the working rotary member rotates in such an engaged state, whereby a cloth to be treated is conveyed passing through between the mentioned part of the peripheral surface of the working rotary member and the pressure-contact member, and during such conveying step a hydraulic pressure is applied to the cloth from the circular arc-shaped concave portion, whereby the cloth is pressed to come in contact with the peripheral surface of the working rotary member. Since the cloth to be treated is conveyed in the mentioned state of close contact with the peripheral surface of the working rotary member, that surface of the cloth is scratched by the roughened peripheral surface of the working rotary member, whereby the fiber structure of yarns forming the cloth is scratched and fluff is raised. At this time, the cloth is subject to friction with fine irregular surface such as grindstone or sand cloth, being different from a large number of known sharp small projections such as card cloth or teazel, and therefore a short fluff is raised on the surface of the cloth. Since some heat is bound to be generated in the cloth due to incidental friction, water is applied to the cloth from the circular arc-shaped concave the pressure-contact member. As a result, not only is the cloth cooled immediately by the water but, also, the water performs the function of a lubricant to facilitate a smooth contact between the cloth and the peripheral surface of the working rotary member, whereby fibers of the cloth are prevented from being cut of.

Furthermore, even when some fluff and waste thread are separated from the cloth, they are washed away by the water applied to the cloth, and as a result there is no such disadvantage that the separated fluff and waste thread get caught in the peripheral surface of the working rotary member, thus enabling a uniform raising treatment.

In the raising apparatus as described above, the cloth to be treated is caused to pass through between the part of the working rotary member and the adjacent circular arc-shaped concave surface of the pressure-contact member, to be conveyed while a hydraulic presser is applied from the circular arc-shaped surface of the pressure-contact member to the cloth by means of hydraulic pressure applying means so as to press the cloth to come in contact with the peripheral surface of the working rotary member. At this time, the working rotary member is rotated by the driving means and the cloth is conveyed in a state of close contact with the peripheral surface of the rotating working rotary member, and therefore fluff is raised from the surface of the cloth by the roughness of the peripheral surface of the working rotary member. At this time, even if same frictional heat is generated in the cloth, water is applied to the cloth from the circular arc-shaped concave of the pressure-contact member. As a result, the cloth is cooled immediately by the water, and fibers of the cloth are prevented from being cut.

As a result of the foregoing arrangement and function, a product having a thickly formed short fluff can be obtained by the raising method of the cloth according to the invention. Since the cloth is prevented from suffering deterioration due to frictional heat generation and fibers of cloth are also prevented from being cut off, and a cloth of desirable feeling, texture and appearance is obtained through uniform raising treatment. This raising method can be preferably carried out by the raising apparatus according to the invention.

Other objects, features and advantages of the present invention will become apparent in the course of the following description in conjunction with the accompanying drawings.

DETAILED DESCRIPTION OF THE PREFERRED EMBODIMENTS

The preferred embodiment according to the present invention is hereinafter described with reference to the accompanying drawings.

Figure 1:
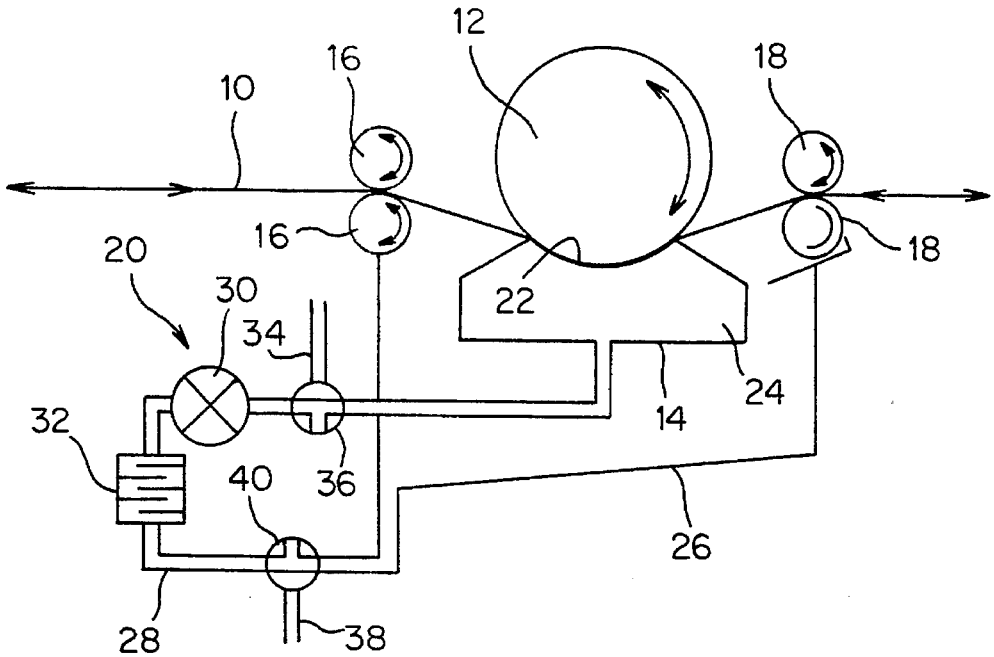
FIG. 1 is a schematic view of a preferred embodiment of an apparatus for carrying out the raising method of treating cloth according to the present invention.

FIG. 1 is a schematic view showing a raising apparatus for carrying out the method of raising a fluff at a treated surface of a cloth according to the present invention. This raising apparatus comprises a working rotary member 12 which is rotatably supported so as to rotate forward and backward (normally and reversely) a around a rotation. A pressure-contact member 14 is disposed in such a manner as to face to a part of a peripheral surface of said working rotary member and cloth conveying mechanism (not illustrated) may be used for conveying a length of a cloth 10 to be treated by passing the cloth through between said part of peripheral surface of said working rotary member 12 and said the cooperating pressure-contact member 14. A pair of squeezing rolls 16, 16 and another pair of squeezing rolls 18, 18 which are respectively disposed vertically putting the cloth 10 therebetween driving means for rotating the working rotary member; water circulation means 20 for supplying water of a predetermined pressure to the cloth 10 and circulating the supplied water for further use are also provided.

The working rotary member 12 is preferably formed of a cylindrical grindstone or of a cylindrical supporting member of which a peripheral surface is coated with sand paper. For forming the working rotary member 12 of grindstone, it is preferable to employ properly various types of grindstone of rough surface such as sandstone and of fine surface such as clayslate according to the intended use. The working rotary member 12 is rotated normally or reversely by a drive motor (not illustrated).

The mentioned pressure-contact member 14 is formed like a container provided with a circular arc-shaped concave surface portion with which a part of the periphery of the working rotary member 12 is cooperatively engaged in use. An internal part of the concave pressure-contact pressure-contact member is formed into a water tank 24. A water outflow opening is formed on the circular arc-shaped concave portion 22 of the surface of pressure-contact member 14.

The water circulation means 20 comprises: a recovery tank 26 which is disposed below the entire part receiving the mentioned working rotary member 12, pressure-contact member 14 and pairs of rolls 16, 16 and 18, 18; a circulation water pipe line 28 of which one end is connected to the bottom of recovery tank 26 and another end is connected to the water tank part of the pressure-contact member 14; a three-way valve 36 which is interposed in the mentioned circulation water pipe line 28 and to which pump 30, filter 32 and water supply pipe 34 are connected; and a three-way valve 40 to which a drain pipe 38 is connected.

The fluff-raising treatment of cloth with the use of the apparatus illustrated in FIG. 1 is performed in the following manner. First, a cloth 10 to be treated is put between a pair of squeezing rolls 16, 16 on the inlet side to pass therethrough, and is then put between a part of periphery of the working rotary member 12 and the circular arc-shaped concave 22 of the pressure-contact member 14 to pass therethrough, and is further put between another pair of squeezing rolls 18, 18 on the outlet side to pass therethrough. Then, the three way valve 36 is switched on so as to supply water through the water supply pipe 34 so that the water tank part 24 of the pressure-contact member 14 and the circulation water pipe line 28 are filled with water, and then the three way valve 36 is switched to drive the pump 30, whereby water is caused to circulate from the circulation water pipe line 28 to the water tank part 24 of the pressure-contact member 14, from the water tank part 24 to the recovery tank 26, from the recovery tank 26 to the circulation water pipe line 28.

After completing the mentioned preparation, the pair of rolls 16, 16 on the inlet side, working rotary member 12 and pair of rolls 18, 18 on the outlet side are respectively driven so as to give a certain tension to the cloth 10. While conveying the cloth 10 at a slow speed while keeping such a tension, water at a selected pressure is caused to flow out through the water outflow opening on the circular arc-shaped concave of the pressure-contact member 14, and with such a water outflow pressure, the cloth 10 is brought in contact with a part of periphery of the working rotary member 12. In this step, the pressure of water flowing out of the outflow opening of the circular arc-shaped concave 22 of the pressure-contact member 14 is controlled so as to also control the pressure required for bringing the cloth 10 in contact with the periphery of the working rotatry member 12. In this manner, the treated surface of the cloth 10 is rubbed or raised by the working rotary member 12 and a short fluff is drawn out of the surface of the cloth 10. Then, rotational direction of the working rotary member 12 and respective pairs of squeezing rolls 16, 16 and 18, 18 is changed between normal and reverse while monitoring surface state of the cloth 10 is carried out. Thus, by rubbing the cloth 10 repeatedly the required number of time in the manner of such as reciprocating movement, a treated cloth on the surface of which short fluff is thickly formed is finally obtained.

Figure 2:
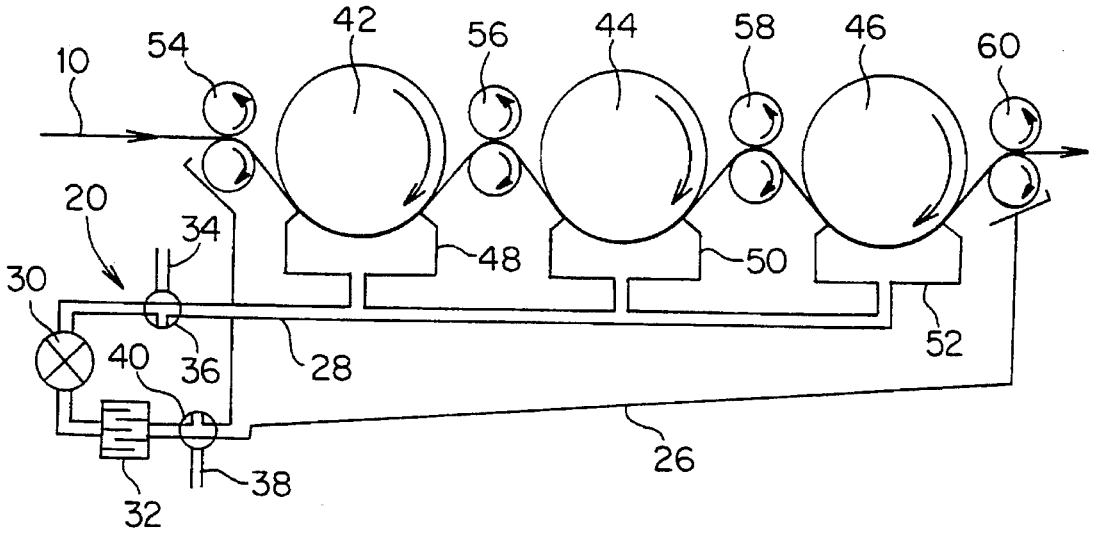
FIG. 2 is a schematic view showing another embodiment of the raising machine for carrying out the raising method of treating cloth according to the invention.

FIG. 2 shows another fluff raising apparatus comprising plural pairs of plurality of working rotary members and pressure-contact member both similar to those shown in FIG. 1. More specifically, this raising apparatus is horizontally provided with three working rotary members 42, 44, 46, and three pressure-contact members 48, 50, 52 are respectively disposed facing to the corresponding working rotary members. This apparatus is arranged so that cloth 10 to be treated is caused to pass sequentially through between a pair of squeezing rolls 54, between the working rotary member 42 and the pressure-contact member 48, between a pair of squeezing rolls 56, between the working rotary member 44 and the pressure-contact member 50, between a pair of squeezing rolls 58, between the working rotary member 46 and the pressure-contact member 52, and between a pair of squeezing rolls 60 to move continuously in one direction. In this arrangement, it is also preferable to give a certain variety in roughness of periphery of the working rotary members 42, 44, 46. The remaining construction is almost the same as that of the apparatus shown in FIG. 1, and detailed description is limited herein to designating the same reference numerals to the same members. In addition, although the respective three pairs of working rotary members 42, 44, 46 and pressure-contact members 48, 50, 52 are disposed in horizontal direction in the apparatus shown in FIG. 2, it is also preferable to dispose them in vertical direction.

Described hereinafter is a specific example of carrying out the raising method of cloth according to the invention.

First, a dyed broad cloth of 100% cotton which is to be treated is brought into contact with the peripheral surface of the working rotary member of a clayslate grindstone at a water pressure of 0.3 kg/cm$^2$, whereby the cloth 10 is moved or conveyed at a speed of about 10 m/min. This conveyance is preferably repeated 12 times, th cloth passing through between the working rotary member and pressure-contact member in a reciprocating manner as mentioned above. The rotating speed of the working rotary member at this time is preferably established to be 30 m/min in peripheral speed. As a result of this operation, a raised cloth on the surface of which fine fluff is thickly and uniformly formed like a leaf of lotus was successfully obtained.

In another such operation, dyed poplin cloth of 100% acrylic fiber which was to be treated was brought into contact with the peripheral surface of the working rotary member of a clayslate grindstone with a water pressure of 0.3 kg/cm$^2$, whereby the cloth 10 was moved or conveyed at a speed of 10 m/min. This conveyance was repeated 10 times, the cloth passing through between the working rotary member and pressure-contact member in a reciprocating manner as mentioned above. The rotating speed of the working rotary member at this time was established to be 25 m/min in peripheral speed. As a result of this operation, a raised cloth on the surface of which fluff is thickly formed like a fruit of peach was successfully obtained.

What is claimed is:

1. A method of raising cloth fibers at a surface of a cloth, comprising the steps of:

conveying a length of cloth which is to be treated through a space between a working rotary member, said rotary member being driven round an axis and comprising one of either a cylindrical grindstone or a cylindrical supporting member having a peripheral surface coated with sand cloth, and a pressure-contact member having a circular arc-shaped concave surface with which a part of a peripheral surface of said working rotary member cooperates to engage the cloth and which is disposed in such a manner that said circular arc-shaped concave surface faces closely to said part of the peripheral surface of said working rotary member; and applying a pressure via said pressure-contact member to the cloth, while conveying the cloth by rotation of the working rotary member, so that the cloth is brought into close contact with the peripheral surface of the working rotary member.

2. The method according to claim 1, wherein:

the conveying step comprises the further step of reversing a direction in which the rotary member is rotated during use.

3. The method according to claim 1, comprising the further step of:

applying a tension to said cloth while it is being conveyed in said conveying step.

4. The method according to claim 2, comprising the further step of:

applying a tension to said cloth while it is being conveyed in said conveying step.

5. Apparatus for raising cloth fibers at a surface of a cloth, comprising:

a working rotary member which is rotatably supported so as to rotate around an axis of rotation, said rotary member comprising one of either a cylindrical grindstone or a cylindrical supporting member having a peripheral surface coated with sand cloth;

a pressure-contact member having a circular arc-shaped concave surface with which a part of the peripheral surface of said working rotary member cooperates to engage the cloth, said pressure-contact member being disposed such that said circular arc-shaped concave surface thereof faces closely to a part of the peripheral surface of said working rotary member, wherein an internal part of said pressure-contact member includes a water tank part and a water outflow opening is provided in said circular arc-shaped concave surface to communicate with said water tank part;

cloth conveying means for conveying a length of the cloth to be treated by passing the cloth between said part of the peripheral surface of said working rotary member and said circular arc-shaped concave surface of the pressure-contact member;

driving means for rotating said working rotary member; and hydraulic pressure application means for supplying water to said water tank part of the pressure-contact member and causing water to flow out through said water outflow opening of the circular arc-shaped concave to apply hydraulic pressure to the cloth, thereby pressing the cloth on the peripheral surface of said working rotary member.

6. The apparatus according to claim 5, further comprising:

a recovery tank for recovering water flowing out through the water outflow opening, to utilize the water in a recycling manner by said hydraulic pressure application means.

7. The apparatus according to claim 5, further comprising:

cloth tensioning means for applying a tension to said cloth while said cloth is being conveyed by said conveying means.

8. The apparatus according to claim 5, wherein:

said driving means reverses a direction of rotation of the working rotary member during use.

9. The apparatus according to claim 7, wherein:

said driving means reverses a direction of rotation of the working rotary member during use.

10. A multistage apparatus, comprising:

a plurality of serial stages each used for raising cloth fibers at a surface of a cloth, wherein each of said stages comprises a working rotary member which is rotatably supported so as to rotate around a respective axis of rotation, said rotary member comprising one of either a cylindrical grindstone or a cylindrical supporting member having a peripheral surface coated with sand cloth; and a pressure-contact member having a circular arc-shaped concave surface portion with which a part of the peripheral surface of said working rotary member cooperates to engage the cloth, said pressure-contact member being disposed such that said circular arc-shaped concave surface portion thereof faces closely to a part of the peripheral surface of said working rotary member, wherein an internal part of said pressure-contact member includes a water tank part with a water outflow opening provided in said circular arc-shaped concave surface portion to communicate with said water tank part;

cloth conveying means for serially conveying a length of the cloth to be treated by passing the cloth between said part of the peripheral surface of said working rotary member and said circular arc-shaped concave surface portion of the contact member of each of said stages;

driving means for rotating each of said working rotary members of said stages; and hydraulic pressure application means for supplying water to said water tank part of each of the pressure-contact members and for causing water to flow out through each of said water outflow openings of corresponding concave surface portions to apply hydraulic pressure to the cloth in each of said stages, thereby serially pressing the cloth on the peripheral surfaces of said working rotary members.

11. The multistage apparatus according to claim 10, further comprising:

a recovery tank for recovering water flowing out of said water outflow openings to utilize the recovered water in a recycling manner by said hydraulic pressure application means.

12. The multistage apparatus according to claim 10, wherein:

said working rotary members of said stages rotate about respective axes disposed in an horizontal arrangement.

13. The multistage apparatus according to claim 10, wherein:

said working rotary members of said stages rotate about respective axes disposed in a vertical arrangement.

14. The multistage apparatus according to claim 10, wherein:

said driving means reverses a direction of rotation of said working rotary member of each of said stages.

15. The multistage apparatus according to claim 14, further comprising:

a recovery tank for recovering water flowing out of said water outflow openings to utilize the recovered water in a recycling manner by said hydraulic pressure application means.

16. The multistage apparatus according to claim 10, further comprising:

cloth tensioning means for applying a tension to said cloth while said cloth is being conveyed by said conveying means serially through each of said steps.

17. The multistage apparatus according to claim 16, wherein:

said cloth tensioning means comprises a plurality of pairs of cooperating rollers, with said cloth being passed between cooperating rollers of each of said pairs of rollers.

18. The multistage apparatus according to claim 16, wherein:

said driving means reverses a direction of rotation of said working rotary member of each of said stages.

* * * * *